US006565422B1

(12) United States Patent
Homma et al.

(10) Patent No.: US 6,565,422 B1
(45) Date of Patent: May 20, 2003

(54) POLISHING APPARATUS USING SUBSTANTIALLY ABRASIVE-FREE LIQUID WITH MIXTURE UNIT NEAR POLISHING UNIT, AND PLANT USING THE POLISHING APPARATUS

(75) Inventors: Yoshio Homma, Hinode (JP); Hiroki Nezu, Hamura (JP); Takeshi Kimura, Higashimurayama (JP); Seiichi Kondo, Kokubunji (JP); Noriyuki Sakuma, Hachioji (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/507,787

(22) Filed: Feb. 22, 2000

(30) Foreign Application Priority Data

Feb. 19, 1999 (JP) ..... 11-041046

(51) Int. Cl.[7] ..... B24B 1/00; B24B 7/00

(52) U.S. Cl. ..... 451/67; 451/60; 451/446

(58) Field of Search ..... 451/36, 41, 53, 451/60, 67, 287, 288, 289, 446, 447; 438/692, 693; 216/88, 89

(56) References Cited

U.S. PATENT DOCUMENTS 1,740,005 A * 12/1929 Crowley
4,242,841 A * 1/1981 Ushakov et al.
5,775,980 A * 7/1998 Sasaki et al. ..... 451/285
5,957,759 A * 9/1999 Cardenas et al. ..... 451/60
6,059,920 A * 5/2000 Nojo et al. ..... 451/60 X
6,106,714 A * 8/2000 Chiu et al. ..... 210/321.63
6,106,728 A * 8/2000 Iida et al. ..... 210/743
6,206,756 B1 * 3/2001 Chopra et al. ..... 451/28
6,257,965 B1 * 7/2001 Kamikubo et al. ..... 451/60

FOREIGN PATENT DOCUMENTS

| | | |
|---|---|---|
| JP | 2278822 | 11/1990 |
| JP | 864562 | 3/1996 |
| JP | 8083780 | 3/1996 |
| JP | 9306881 | 11/1997 |
| JP | 10125880 | 5/1998 |

OTHER PUBLICATIONS

"An Examination of Slurry for Wiring Metal's Chemical Mechanical Polishing" by Kenji Sakai, et al pp. 35–37, vol. 41 No. 1 1997.
"A New Slurry–free CMP Technique for Cu Interconnects" By M. Matsumoto, et al . pp. 5–72–5–78.

* cited by examiner

*Primary Examiner*—Timothy V. Eley
(74) *Attorney, Agent, or Firm*—Antonelli, Terry, Stout & Kraus, LLP

(57) ABSTRACT

In order to resolve problems of an increase in cost of transportation and vessels for polishing solutions to polish metal films, and of aging change of the polishing solutions, apparatus for preparing and mixing solutions of polishing materials without including abrasive are installed at a site the same as a site of polishing apparatus, an abrasive free slurry is supplied to the polishing apparatus and a metal film on a wiring substrate is polished to thereby form embedded metal wirings by which the cost of polishing metal can significantly be reduced and stability of the polishing solution is promoted.

21 Claims, 6 Drawing Sheets

POLISHING APPARATUS USING SUBSTANTIALLY ABRASIVE-FREE LIQUID WITH MIXTURE UNIT NEAR POLISHING UNIT, AND PLANT USING THE POLISHING APPARATUS

BACKGROUND OF THE INVENTION

The present invention relates to a polishing apparatus for fabricating a wiring substrate and a fabrication method of a wiring substrate using such apparatus, particularly to a polishing apparatus and a polishing method for fabricating metal wirings for a semiconductor device by using a polishing operation.

In recent years, importance is given to planarizing of a surface of a wiring substrate for a large scale semiconductor integrated circuit (hereinafter, described as LSI). A method of Chemical Mechanical Polishing (CMP, hereinafter, described as polishing so far as the description is not specified otherwise) is regarded as one of the representative technologies.

Further, as a method of fabricating copper or a copper-based alloy (Here, a copper-based alloy means an alloy in which the weight percentage of Cu in the materials which compose the alloy is larger than the weight percentage of any other material in the alloy; hereinafter, described as copper alloy.) for interconnect metal lines, a method referred to as the damascene method attracts attention and is disclosed in, for example, JP-A-2-278822. Here, a single damascene method is described in U.S. Pat. No. 6,004,880, the contents of which are incorporated herein by reference in their entirety. And a dual damascene method is described in U.S. Pat. No. 6,004,188, the contents of which are incorporated herein by reference in their entirety. Among the methods, in respect of polishing a copper alloy, a detailed description has been given in JP-A-8-83780.

Methods of polishing are roughly classified into methods of using abrasive powders and methods of substantially not using abrasive powders. The former is mainly used for planarizing a surface of a predetermined substrate or removing projected portions of thin films. The latter has mainly been used for removing damaged or degraded portions of a surface after polishing using abrasive powders as described in, for example, JP-A-9-306881. Further, conventionally, according to the polishing operation of not using abrasive powders, generally polishing speed is extremely low and therefore, although there has been a technology of polishing without using abrasive grains with an object of removing a predetermined layer after a polishing using abrasive powders and thereafter removing mainly a damaged layer of the surface, it has been regarded as practically difficult to remove the predetermined layer by the polishing of not using abrasive grains. For example, in respect of polishing of aluminum, there has been proposed a method of using an alkaline polishing solution without including abrasive powders in Japanese Laid Open No.2-580939. However, according to the method, the polishing speed is as low as 30 nm/min at maximum. Further, in a practical point of view, polishing with high accuracy is difficult unless the ratio of polishing rate to etching rate is larger than 20 hereinafter, described as selectivity ratio), but the selectivity ratio of the proposed method is as small as 3 or smaller. Further, there has been carried out a trial in which a copper alloy is polished by an abrasive free solution. A description has been given to an example of using nitric acid or a mixture solution of nitric acid and hydrogen peroxide which does not include abrasive in Proceedings of Abrasive Fabrication Society 1997, volume 41, pp. 231–233. However, nitric acid is a chemical used in etching copper and according to the solution, the etching rate is as large as the polishing speed and therefore, although an effect of smoothing a polished face can be expected, in using it in a process of so-to-speak damascene wiring the process is devoid of consideration in respect of the etching rate and is not suitable for practical use.

Further, there is disclosed a method of polishing a silicon wafer or a glass substrate by a method of not including abrasive powder in a polishing solution by using a polishing pad (described as grindstone) including fixed abrasive powders of silica, cerium oxide or the like in place of a polishing pad made of polymer resin in JP-A-10-125880 or JP-A-8-64562. Further, Proceedings of SEMI Technology Symposium, 1998 edition p. 5-72 to p. 5-78, describes also a method of polishing a copper alloy by using a similar grindstone. However, the specific content of the grindstone or the polishing solution used is not disclosed and the grindstone and the polishing solution are supplied together from the supplier of the consumables.

Paying attention to an aspect of polishing characteristics, slurries are roughly classified into alkaline slurries (described as mechanical effect slurry) mainly realizing the polishing characteristics by mechanical effects and polishing liquids (solutions) enhancing a role of chemical reaction. The former is mainly used in polishing silicon oxide or silicon. In contrast thereto, a chemical effect suspension is mainly used in selective polishing. According to the chemical effect suspension, normally, in addition to abrasive powder and a dispersant, a chemical effect suspension including acids or salts of these is mixed with an oxidant immediately before the use to thereby constitute a slurry and the slurry is used in polishing by injecting it to a platen for polishing. As the oxidant, ferric nitrate, hydrogen peroxide, potassium iodate or aqueous solutions of these are known. Hereinafter, in respect of the chemical effect slurry, a liquid before mixing with an oxidant is referred to as a suspension and a liquid after having mixed with an oxidant is referred to as a slurry as a discrimination therebetween when the discrimination becomes necessary.

However, in the case of a chemical effect suspension, abrasive powders are liable to aggregate in the suspension and it is difficult to provide uniformly dispersed suspension. Further, even in the case of a suspension which has once dispersed, the suspension is liable to become a nonuniform suspension or slurry by the aggregation or settling of the powders. When a slurry in a nonuniformly dispersed state is used, polishing scratches are made on the surface of a metal film or insulating layer and results in a failure, and therefore, technologies for preventing these, for example, technologies for providing a uniformly dispersed suspension by, for example, a kind and a concentration of a dispersant or by stirring a solvent including abrasive powder and chemical components for a predetermined period of time while maintaining at a predetermined temperature, become an important problem in the technical aspect for polishing suspensions.

Further, a chemical effect suspension is produced by mixing abrasive powder and a dispersant thereof, further, a plurality of kinds of acid or complex salt, or a protective layer forming agent and so on under strict composition control and therefore, it is extremely difficult for a user to control the chemical components. Such a chemical effect slurry including abrasive powder requires complicated and delicate production steps and a long period of time seems to be required in the production.

As mentioned above, in the case of the chemical effect suspension, the composition is complicated and therefore, in using the chemical effect suspension continuously in fabricating interconnect substrates, a chemical effect suspension is transported from a production site to a site of using the chemical effect suspension, contained in a predetermined reception apparatus and thereafter, mixed with an oxidant at a predetermined rate and supplied and used in a polishing apparatus as a chemical effect slurry. The reception apparatus mentioned here indicates a suspension or slurry supply unit for an individual polishing apparatus, a concentrated reception apparatus for supplying the suspension or slurry to a plurality of polishing apparatuses or the like. In this way, according to a polishing method using a chemical effect suspension, chemical components of a slurry are complicated and the composition control is also difficult and therefore, there poses a problem in which in addition to the cost of producing a suspension per se, a waste solution treatment of the polishing liquid requires high cost.

SUMMARY OF THE INVENTION

The inventors have found that polishing of metal can be carried out at a practical high speed even with a combination of a liquid (e.g., slurry) which does not include substantially abrasive powder in the suspension or slurry and a polishing pad made of polymer resin which does not substantially include abrasive powder. This abrasive-grain-free chemical mechanical polishing is described in U.S. patent application Ser. No. 09/182,438, the contents of which are incorporated herein by reference in their entirety. In this case, an abrasive free slurry signifies a slurry having a concentration of abrasive powder of less than one weight percent of combined weight of liquid and abrasive in respect of the slurry. When a particularly preferable composition is used, practical polishing can be carried out even with a concentration of abrasive powder equal to or smaller than 0.1 weight percent (having less than 1 weight percent concentration of abrasives powder, this is also referred to herein as abrasive free suspension or slurry).

By abrasive free slurry according to the present application, we mean a slurry having a concentration of abrasive powder of less than 1 weight percent of combined liquid and powder in respect of the slurry, which would include a liquid containing no abrasive powder (e.g., a polishing liquid such as a solution, with no abrasive powder). Thus, while throughout this application a suspension or slurry is referred to, within the contemplation thereof by the inventors is a polishing liquid in general, e.g., a polishing solution, containing no, or substantially no, particulate matter including abrasive powder.

(1) According to the present invention, in respect of the above-described abrasive free slurry, the abrasive free suspension per se need not be produced at a production site of the slurry, but materials constituting the abrasive free suspension or solutions of the materials for making the suspension are prepared and transported to a site where the suspension is used; successively, at the site of use, solutions of the materials are produced and the solutions are mixed with each other and diluted and mixed with an oxidant to produce and use as the predetermined abrasive free slurry.

By installing a production equipment of an abrasive free slurry at a site substantially the same place as a polishing apparatus in this way, that is, by making an abrasive free slurry at a portion of the polishing apparatus or at a vicinity of the polishing apparatus or in the same plant (factory), there is achieved an effect of reducing cost of transportation of the suspension from a production site to a site of use or cost of vessels. In case that the production equipment of an abrasive free slurry is installed in the vicinity of the polishing apparatus, the distance between them is desirably within 1 km substantially, preferably within 400 m. In other words, a polishing apparatus of the invention has a polishing unit, a mixture unit, which mixes polishing materials so as to prepare a liquid, supplied to the polishing unit, the liquid including abrasive powder concentration less than 1 weight percent of combined weight of liquid and abrasive powder, and piping directly connecting the polishing unit to the mixture unit. This piping directly connecting the polishing unit to the mixture unit includes the case that there is some object like a filter between the polishing unit and the mixture unit. Or a polishing apparatus has a polishing unit, and a mixture unit, which mixes polishing materials so as to prepare a liquid, supplied to the polishing unit, the liquid including abrasive powder concentration less than 1 weight percent of combined weight of liquid and abrasive powder, the mixture unit having a supplying structure which provides continuous flow communication between the polishing unit and the mixture unit.

Further, only raw materials for polishing are transported from a production site of raw materials for a suspension to a site of use and accordingly, the volume to be transported is significantly reduced. For example, chemical components included in an abrasive free suspension are several percent of the suspension at most and accordingly, compared with a case in which a completed abrasive free suspension is transported, the transportation volume can be reduced to about ten percent. Further, when polishing component materials are prepared by being divided into a single one of components for a suspension in the completed state or a solution of a single material having a concentration 10 times or more as much as that in use or a solution comprising a mixture of a plurality of kinds of materials for facilitating preservation or transportation and transported to a site of use, the difficulty in inspection at a production site is reduced and accordingly, cost of the abrasive free suspension or slurry, and therefore, fabrication cost of a wiring substrate, can be significantly reduced.

For example, an abrasive free suspension before being mixed with an oxidant contains polishing materials of a plurality of kinds of organic acids or salts of these, a protective layer forming agent and the like. Total concentration of these are less than 10 weight percent of the suspension at most. Accordingly, when a raw chemical for an abrasive free suspension is transported to a site of use individually or in the form of a partially mixed condensed solution by using the method of the present invention, there can be constituted a solution having a concentration ten times or more as high as that in use. Although a concentration constituting a limit differs depending on a polishing material, specifically, there can be constituted a solution having a dissolution limit in consideration of environmental temperature in transportation, for example, a concentration equal to or higher than 20 weight percent. In contrast thereto, benzotriazole (described as BTA) which is known as a representative protective layer forming agent, a concentration thereof added to a polishing solution is equal to or less than 0.5 weight percent at most and it is dissolved in water by about 2 weight percent at normal temperature. The effect is low since it can be condensed only by several times. With regard to such a material, a method of making a solution by transporting it in the form of a solid to a site of use is more advantageous. Although the transportation cost can significantly be reduced in the form of a solid state, handling at a site of use is more facilitated in the case of a solution state. Which material a user receives in which state may be determined in consideration of a fabrication apparatus according to the invention or an environment where the fabrication apparatus is installed.

Further, generally, in a chemical effect suspension, there poses a problem in which reaction among components is progressed and properties of the polishing solution are liable to change by aging. However, by using the method of the present invention, a slurry can be used in a short period of time after it has been prepared, and, accordingly, there is no need of considering an aging change or adding a stabilizer for extending life of the solution.

According to an example, which has frequently been used in recent years in polishing tungsten, a suspension including silica abrasive powder and an aqueous solution of hydrogen peroxide are mixed and used in polishing. According to the slurry, ferric nitrate used conventionally may not be used as an oxidant, and therefore, it has been expected that adverse influence thereof on characteristics of devices may not be considered. However, it has been found that ferric nitrate of about several tens to several hundreds ppm has to be added to the suspension. Ferric nitrate seems to have also an effect of a dispersant of abrasive powder. Therefore, it has been found that the adverse influence on device characteristics caused by contamination of iron cannot be disregarded. Further, according to a slurry including fine cerium oxide abrasive powder (having an average particle size of 0.3 micrometer or smaller) which is widely used in polishing an insulating film, although the abrasive agent immediately after dispersion shows excellent characteristics, after preserving it for about two months after dispersion aggregation occurs therein and a number of scratches are generated. Although various kinds of surfactants are added in order to prevent this, the content has not been disclosed. According to a surfactant of sulphonic acid or polyacrylic acid or the like, which is widely used, the polishing speed is lowered. In this way, in order to stably disperse abrasive powder, control of particle size or addition of a dispersant is needed although it is not preferable in view of polishing performance per se. This is to guarantee the life of the suspension for about three months or more. In contrast thereto, an abrasive free suspension does not include abrasive powder and therefore, only components necessary for polishing may be included.

The abrasive free slurry includes polishing abrasive powder of less than one weight percent, an oxidizing substance, a substance for making an oxide water soluble and a corrosion preventing substance. This corrosion preventing substance is described in Japanese Laid Open Number 8-64594, the contents of which are incorporated herein by reference in their entirety. Actually, a metal film on an insulating film is polished by using a slurry including abrasive powder of less than one weight percent, an oxidizing substance, a substance for making an oxide water soluble and a corrosion preventing substance in which pH and oxidation-reduction potential fall in a corrosion area of the metal film. When the slurry is used, not only a sufficiently practical polishing speed can be provided by a combination with a conventional polishing pad but also there is achieved an advantage in which scratches are difficult to be made on a polished face. Particularly, the slurry is preferable in forming metal wirings of an LSI using the damascene method. Further, abrasive powder is not included, and, therefore, reduction in cost of a suspension and simplification of handling are also expected.

An abrasive free suspension is prepared by dissolving and mixing various kinds of polishing materials in a solvent, and an abrasive free slurry is prepared by mixing the suspension with an oxidant under a diluted state as necessary. Further, the order of mixing is not limited thereto. According to the abrasive free slurry, all of the included components are dissolved and it has been found that production apparatus for supply thereof can be provided comparatively in small size and inexpensively.

In this case, as an oxidizing substance of the abrasive free slurry, hydrogen peroxide solution is most preferable since it does not include metal components and is not a strong acid. Although ferric nitrate or potassium periodate includes a metal component, it achieves an effect of increasing the polishing speed since the oxidizing power is strong.

Further, as a substance for making an oxide water soluble, acid is pointed out, and operation thereof for making an oxide water soluble as metal ions (for example, $Cu^{2+}$ ions) is utilized. There are inorganic acid, organic acid and salts of these. Specifically, although benzoic acid, oxalic acid, malonic acid, succinic acid, adipic acid, pimelic acid, maleic acid, phthalic acid, malic acid, tartaric acid, citric acid and salts of these or mixtures of these are particularly effective, the substance is not limited thereto.

These acids or complex compounds may constitute a solution of a polishing material having a predetermined concentration in a mixture vessel regardless of whether they are in a solid state of in a solution state. These materials are dissolved in water comparatively easily.

Next, as a corrosion preventing substance, that is, the protective layer forming agent, in respect of a copper alloy, BTA is known most widely and shows the strongest effect. Otherwise, one or a plurality of substances selected from the group consisting of polymers including monomers having carboxylic acids of BTA derivatives, polyacrylic acid and salts of these are effective.

(2) Next, an explanation will be given of a specific polishing step. First, one or a plurality of solutions or solids of polishing materials are dissolved in a solvent individually or in a mixed state to thereby prepare an abrasive free suspension and the abrasive free suspension is diluted by using a solvent as necessary. Or, when there are a plurality of kinds of solutions of polishing materials, these are mixed to prepare an abrasive free suspension, the abrasive free suspension is diluted as necessary and the abrasive free suspension and an oxidant are mixed to thereby prepare an abrasive free slurry. However, an oxidant may not be constituted only by the oxidant but may include at least portions of components of polishing materials (a mixture solution of an oxidant or a portion of a component of a polishing solution whose major component is an oxidant, which differs from a composition finally used in polishing, is summarizingly described as an oxidant). The abrasive free slurry prepared in this way is supplied to a polishing apparatus.

Successively or separately therefrom, a wiring substrate formed with an insulating film having a predetermined thickness on its surface is prepared, grooves for wirings are formed in the insulating film and one layer of a metal layer for wirings or metal layers for wirings substantially including an upper metal layer and a lower metal layer are formed and embedded into the grooves. "Substantially" described here signifies that the metal layers are classified into metal layers having different polishing characteristics and an upper or a lower metal layer does not need to be constituted by a single layer, respectively, so far as the polishing characteristic is similar. Further, when the wiring metal layers are divided into more layers in view of polishing characteristics, the method of the present invention in respect of a lower metal layer may be used as an application. An explanation will be given of a case of comprising upper and lower metal layers as follows.

Further, when the wiring metal material is mainly aluminum, the ratio of the polishing speed to the etching rate which determines the polishing accuracy is small and is not sufficiently practical; however, low cost formation can be achieved by using the method of the present invention. Further, when the wiring metal material is tungsten, the polishing operation can similarly be carried out by optimizing a composition of an organic acid or the like according to the present invention.

Successively, the wiring substrate is pressed to a polishing platen while injecting the abrasive free slurry and at least a portion of an upper metal layer is removed. When a lower metal layer is difficult to polish by the abrasive free slurry, another kind of an abrasive free slurry may further be supplied. Particularly when the lower metal layer is made of a material which is difficult to polish such as tantalum (described as Ta), the wiring substrate may be moved to another platen and polishing may be carried out further by using a slurry including conventional abrasive powder. When only the abrasive free slurries are used, a plurality of abrasive free slurries may be used on the same platen or other platens may be used respectively. Further, the lower metal layer may be removed not by polishing but by etching.

Further, according to the present invention, there also is achieved an advantage in which polishing conditions can continuously be changed during polishing. In the case of the abrasive free slurry, the polishing speed of a metal layer can be increased by a method of increasing a concentration of an acid or a complex salt or reducing a concentration of a protective layer forming agent. However, there is a tendency of also increasing the etching rate, and, accordingly, when excessive polishing is carried out, dishing is liable to increase considerably at the end of metal polishing. Accordingly, at an initial stage of polishing, the polishing is carried out until the surface of the metal layer becomes substantially flat under conditions of a combination of high polishing speed and high etching rate, successively, the polishing operation is carried out by changing the conditions to a low etching rate, by which the polishing operation can be carried out in a short period of time and further, an increase in dishing can be restrained in excessive polishing.

Further, high speed polishing can be carried out in respect of various kinds of materials by applying the abrasive free slurry also to polishing using a grindstone.

Further, from another aspect, within 24 hours from preparing an abrasive free slurry by mixing, the abrasive free slurry is used to polish a film. Desirably the abrasive free slurry is used to polish a film within 4 hours from preparing the abrasive free slurry, because the abrasive free slurry contains the oxidizing substance so that the chemical reaction progresses by mixture with an oxidizing substance gradually.

(3) Successively, an explanation will be given of a site of installing a supply system of an abrasive free suspension. When various kinds of polishing materials for preparing an abrasive free suspension are powders, a portion of preparing the supply system for the solutions of the polishing materials are installed outside of a clean room for fabricating wiring substrates and when a successive system, handling the solutions of the polishing materials, is installed in the clean room, an area occupied in the clean room which needs expense in administration can be reduced. The reason why, a portion other than the portion of preparing the solutions from the powders is installed in the clean room is that in view of polishing step operators, the operational performance is promoted by increasing the ratio of the portion of the system installed in the clean room. Conversely, in view of reducing the cost of administration of the clean room, for example, all of portions of the supply system for the abrasive free suspension should be installed outside of the clean room and only the abrasive free suspension is introduced into the clean room, filtered and thereafter mixed with an oxidant to use for a polishing apparatus by which the occupied area can substantially be minimized.

Further, as a mode intermediary therebetween, it is also possible that the portions of the system for preparing the solutions of the polishing materials are installed in sections in the clean room having a lower grade than those of other areas and having a lower administration cost, or installed at sections provided with a measure of not effecting adverse influence on other portions by installing an enclosure or a local exhausting facility. In this case, intermediary advantage and cost can be realized in view of administration cost and operational performance of the clean room.

In this case, the abrasive free suspension may be mixed with an oxidant after having been introduced into various polishing apparatus or may be introduced into various polishing apparatus after having been mixed with an oxidant.

(4) Successively, an explanation will be given on the supply system of suspension for realizing the present invention. First, when a polishing material is a solid, it is suitable to use a mixing vessel for preparing a solution by adding a predetermined amount of water to the polishing material. A stirring function or another function may be provided for expediting dissolution; for example, when water temperature is elevated, the dissolving may be enhanced. A method of accelerating dissolution of a material which is difficult to dissolve is not limited thereto but pertinent function may be added to the mixing vessel. When all of included components are put into the same mixing vessel and dissolved in a solvent in one operation by predetermined rates of concentrations, the abrasive free suspension can immediately be provided. Further, when a plurality of kinds of solutions are prepared, the abrasive free suspension can be constituted by mixing these by predetermined rates. Further, when polishing materials are supplied in the form of liquid, the individual mixing vessel may only be provided with a function of constituting a predetermined concentration by mixing with water. Naturally, stirring function may be provided as necessary. Further, as stirring function, there can be used a method of rotating a rotor such as a propeller in a liquid or a method of circulating the polishing solution by using a pump. The above-described abrasive free suspension may be prepared at a concentration which can be used as it is or a concentration at an intermediary stage which is higher than a concentration in actual use in consideration of easiness of handling such as size of the vessel. Further, as a method of constituting the abrasive free suspension by mixing solutions of polishing materials, there can be used a method of taking out continuously the solutions of the individual polishing materials by predetermined flow amounts per unit time and mixing them to each other (continuous mixing method) or a method of taking out respective predetermined amounts of the solutions of the individual polishing materials and mixing them (batch type mixing method) When a pump by which a constant volume is transferred per cycle(referred as, constant volume pump) is used, a pulsating flow is produced and therefore, the batch type mixing is suitable, however, a pump weakening a degree of a pulsating flow is on sale and when such a pump is used, the continuous mixing method may be used. The prepared abrasive free suspension is transferred to a second mixing unit for mixing with an oxidant. A method of mixing thereof may be the continuous mixing method or the batch type mixing method. The prepared abrasive free slurry is preserved in a buffer vessel as necessary.

As another example of a method of preparing the abrasive free suspension, there may be used, for example, a method of preparing a solution of a polishing material which is difficult to dissolve in water and successively adding other polishing materials to the solution. In mixing the abrasive free suspension with an oxidant, it is preferable to dilute and prepare the abrasive free suspension previously to a concentration of use. Because when the abrasive free suspension is at a high concentration, reaction with an oxidant may be expedited and life of the slurry may be deteriorated. Naturally, when the degree of deterioration is retarded to a nonproblematic degree, the abrasive free suspension may be mixed with the oxidant before dilution. Further, in the case of a solution of a pertinent polishing material which is slow to react with an oxidant, the solution may be mixed with the oxidant before mixing all of components of the abrasive free suspension.

The abrasive free slurry prepared in this way may be supplied directly to one or a plurality of polishing apparatus by pipings or may be transferred temporarily to another vessel and transported and supplied to the polishing apparatus which are not connected directly thereto.

When a pump for taking out the above-described solutions of the polishing materials or the abrasive free suspension from the mixing vessel is a tube pump or a constant volume pump, the flow rate may be oscillated as in a pulsating flow and stable mixing may not be carried out or predetermined rates of components may be deviated only by coupling pipings. In such a case, when a buffer tank for mixing is installed and stirring function is provided as necessary, it is preferable in stabilizing the composition. In order to promote the accuracy of controlling the composition of the abrasive free suspension, it is preferable to make concentrations of solutions of polishing materials near to low concentrations such that the abrasive free suspension having a predetermined concentration is prepared only by mixing them. However, when the accuracy of controlling a constant volume pump or the like for taking out solutions of polishing materials is sufficiently high, concentrations of the polishing materials may be made high and constant amounts thereof may be taken out by pumps and diluted. This method is suitable for preparing a large amount of a suspension. It is preferable that a control deviation of a pump is plus or minus 10 percent or less in respect of a predetermined flow rate (average value when a pulsating flow is constituted). Further, when individual polishing apparatus are attached with a diluting portion for the abrasive free suspension by water, the abrasive free suspension at an intermediary high concentration may be prepared in a supply system. Further, when individual polishing apparatus are attached with a function of adding an oxidant to the abrasive free suspension, only the abrasive free suspension may be prepared by a supply system and supplied to the polishing apparatus and the abrasive free slurry may be constituted in the polishing apparatus.

Further, it is eftective to remove foreign matters in the abrasive free suspension or the abrasive free slurry by filtration as necessary at a final stage immediately before mixing with an oxidant on the outlet side of the mixing vessel, or a vessel of the suspension. According to the conventional slurry, abrasive powder is included and accordingly, a mesh size of a filter has been very coarse to a degree of 10 micrometers at least. In contrast thereto, according to the method of the present invention, abrasive powder is not originally included in the slurry and accordingly, it is easy to use a filter having a mesh size of 1 micrometer or less. Since such a fine mesh filter can be used, a number of foreign matters in the slurry is considerably reduced, which is effective in reducing polishing scratches. Further, a filter is generally made of polymer resin, and deterioration is liable to progress when it is exposed to an oxidant; accordingly, the filter may be placed at a stage before mixing with the oxidant. However, it is more effective for removing foreign matters to place a filter after mixing with an oxidant, and, accordingly, when a preference is given to removal of foreign matters, a frequency of changing the filter may be increased. Further, there is. resolved a problem in which foreign matters adhered to a vessel in transporting a suspension from a site of producing the suspension, are mixed into the suspension and mixed in transferring to a reception apparatus to thereby cause damage on wiring substrates in polishing.

Further, according to the present invention, a supply system connected to polishing apparatus may be of a plurality of routes. Polishing by using the abrasive free suspension can be carried out not only for a copper alloy constituting an upper metal layer but also for a lower metal layer as a barrier comprising tungsten or titanium nitride and the supply system according to the present invention can be used for polishing the lower metal layer. Conversely, a plurality of polishing apparatus may be connected to one route of a supply apparatus.

When an applied wiring substrate is a silicon wafer for a semiconductor integrated circuit, contamination by alkaline metal, alkaline earth metal or halide is not preferable, it is preferable to restrain amounts of these substantially to 10 ppm or less, and, accordingly, acid or its ammonium salt is preferable; however, contamination can be restrained actually to a nonproblematic level by cleaning technology using a liquid having slight reactivity with a copper alloy. However, cost of a cleaning step is slightly increased. When a wiring substrate is a glass substrate, such a problem may not occur.

In a total amount of a composition of a slurry according to the present invention, concentrations of organic acid and a protective layer forming agent such as BTA or other dissolving components are in a range of 0.001 through 5 percent in respect of water. Their concentrations are very low and accordingly, a large mixing vessel is required to provide a polishing solution having a predetermined amount and charging of materials and taking out of a dissolved suspension must be repeated frequently. In contrast thereto, when solutions of polishing materials having intermediary concentrations twice or more as much as concentrations of use, are prepared and respective predetermined amounts thereof are taken out by a tube pump or the like, mixed and diluted to thereby prepare the abrasive free suspension, downsizing of a mixing vessel can be carried out or, conversely, a frequency of steps of charging, dissolving and diluting polishing materials can be reduced.

Further, many of saturated solubilities of respective polishing materials reach 10 percent or higher except that the saturated solubility of a portion of a protective layer forming agent is several percent. In this case, a method of preparing a solution of a polishing material having a low solubility such as BTA separately from solutions of other polishing materials and mixing both to thereby constitute the abrasive free suspension, is effective. Further, the abrasive free suspension may be prepared by preparing solutions of polishing materials for respective components constituting the abrasive free suspension and mixing these.

Further, in place of a polishing pad made of polyurethane resin which is generally used in polishing, a grindstone can also be used. Cerium oxide in addition to alumina or silica can also be used for abrasive powder included in such a grindstone. When such a grindstone is used, planarity can significantly be promoted than in the case of using a resin pad. However, a grindstone is generally porous, absorbs components of a polishing solution and may effect adverse influence when polishing is repeated or when a polishing solution is changed, particularly in the case of using a chemical suspension. As a countermeasure, there is a method of increasing a supply amount of a chemical suspension or adjusting a composition of a chemical suspension which is supplied such that influence by absorbed components is preserved. In the former case, it is necessary that cost of the chemical suspension is low and in the latter case, it is necessary to flexibly adjust a composition rate of the chemical polishing solution. Although these are difficult to deal with according to a method of transporting and using a completed suspension as in the conventional case, according to the supply system and the fabrication method of the present invention these can be dealt with comparatively easily.

DETAILED DESCRIPTION OF THE PREFERRED EMBODIMENTS

Embodiment 1

Figure 1A:
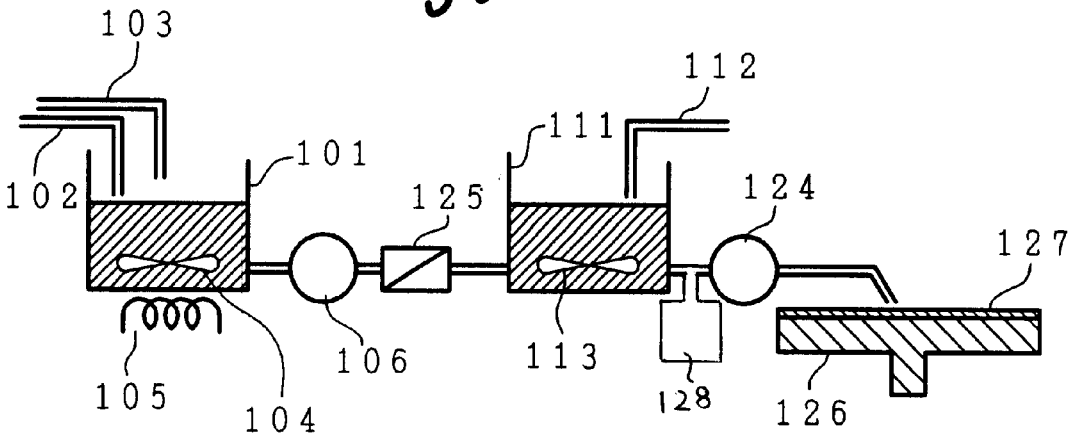
FIGS. 1*a*, 1*b*, 1*c* and 1*d* are views showing a case of preparing an abrasive free slurry from mixed polishing materials.

An explanation will be given in reference to FIGS. 1*a*, 1*b*, 1*c* and 1*d*. As shown by FIG. 1*a*, a solid polishing material including 15 g of citric acid and 30 g of BTA which is a protective layer forming agent, is supplied from a supply port 103 to a first mixing vessel 101 and 7 liters of deionized water is charged from a supply port 102 to thereby completely dissolve the polishing material and constitute an abrasive free polishing solution. The protective layer forming agent is difficult to dissolve in water and therefore, a stirrer 104 of a propeller type belonging to the first mixing vessel 101 is operated. Further, in order to dissolve the solid polishing material in a short period of time, liquid temperature is elevated to 30° C. by using a heater 105. Thereby, the polishing material can be dissolved in a time period of ⅓ or shorter of that in the case of the liquid temperature at 22° C. Next, a total amount of the abrasive free polishing solution is transferred to a first slurry vessel 111 via a filter 125 by using a pump 106 and 3 liters of hydrogen peroxide solution (made by Wako Junyaku, reagent special class, 30 percent concentration, hereinafter, the product is used unless specified otherwise) is charged via a supply port 112 and mixed with the abrasive free suspension to thereby form an abrasive free slurry. Next, the abrasive free slurry is taken out at a rate of 0.2 liter/min from the slurry vessel 111 by a pump 124 and is introduced onto a platen 126 in a polishing apparatus (not illustrated) as necessary.

Figure 1B:
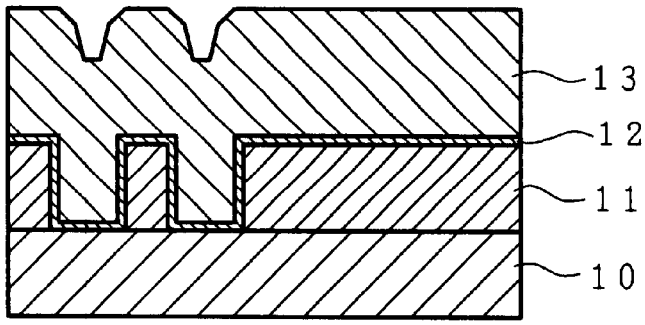
Figure 1C:
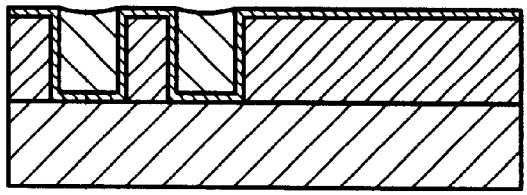

Successively or in parallel therewith, as shown by FIG. 1*b*, a wiring substrate comprising a silicon wafer of 6 inch diameter is prepared. FIG. 1*b* shows a state in which grooves for wirings are formed in an insulating layer 11 having a thickness of 0.5 micrometer comprising silicon oxide formed on a wiring substrate 10; as a lower metal layer 12, a layer of titanium nitride having a thickness of 50 nm is formed by using a publicly-known reactive sputtering process; and successively, as an upper metal layer 13, a layer of a copper alloy having a thickness of 800 nm is formed by a sputtering process and embedded in the grooves by heat treatment. However, the lower metal layer 12 may be of a laminated layer structure in order to improve adhering performance with the insulating layer 11, in which firstly, a thin layer of titanium of several nm(referred as nm) through ten odd nanometer thickness is formed by a publicly-known sputtering process, and, thereafter, the layer of titanium nitride having a predetermined thickness is laminated thereon. Conversely, the lower metal layer 12 may be of a structure in which in order to improve adhering performance between titanium nitride and the upper metal layer 13, after forming a layer of titanium nitride having a predetermined thickness, a thin layer of titanium of about several nm is formed. Although there is achieved an advantage of being easy to improve the adhering performance or conductive characteristic with a lower level wiring (not illustrated) by constituting a laminated structure of a nitride and the metal in this way, there also is a drawback in which resistance of completed wirings is slightly increased substantially. These features are similar to the case when tantalum or its nitride is used for the lower metal layer 12. The wiring substrate 10 is set on a platen 126 having a diameter of 18 inches as shown by FIG. 1*a* in a polishing apparatus (not illustrated), and polishing is carried out while injecting the abrasive free slurry from the slurry vessel 111. As a polishing pad 127, there is used a hard polishing pad IC1000 (commercial name of Rodel Co. Ltd.) made of foamed polyurethane resin and inscribed with lattice grooves. The polishing characteristic at this occasion is about 80 nm/min under conditions of polishing pressure of 200 gram·f per square centimeter (referred as gf per square cm) pad rotational speed per minute(referred as rpm) of the platen 126 of 60 rpm. A platen having a diameter of 18 inches is used also in the following embodiments unless specified otherwise. Polishing time is 11 min. The time corresponds to excessive polishing of about 10% in respect of a film thickness of the upper metal layer at a flat portion (referred as nominal thickness). As shown by FIG. 1*c*, the upper metal layer 13 except the groove portions has been removed almost completely, however, the lower metal layer 12 remains. In this way, by carrying out abrasive grain free polishing as polishing at the first step, the upper metal layer at the flat portion is selectively polished.

Figure 1D:
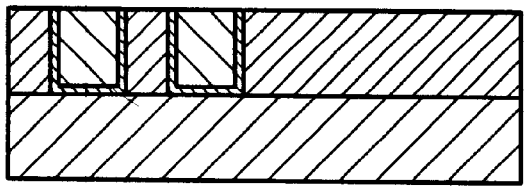

Next, the wiring substrate 10 is moved onto a second platen (not illustrated) and polishing of the lower metal layer 12 is carried out to thereby fabricate the wiring substrate as shown by FIG. 1*d*. As an slurry, a suspension of QCTT1010 (commercial name of Rodel Co. Ltd.), containing alumina abrasive, is mixed with 30% of hydrogen peroxide solution by a volume ratio of 7:3 and added with an aqueous solution of BTA of 2 weight percent to constitute 0.1 weight percent and the polishing is carried out by supplying the slurry similarly at a flow rate of 0.2 liter/min. The QCTT1010 suspension is originally for polishing a copper alloy, however, since BTA is added, the polishing speed of the copper alloy is reduced to 20 nm/min or lower. Further, almost no etching is observed. In contrast thereto, the polishing speed of titanium nitride is about 50 nm/min which is almost unchanged by adding BTA. Since such a slurry for the lower metal layer is used, as shown by FIG. 1*d*, the upper metal layer in the grooves is not polished and the lower metal layer 13 except the grooves can stably be removed. Even when excessive polishing of 100% is carried out in respect of the lower metal layer, an increase in an amount of dishing of the upper metal layer stays to be about 30 nm and it has been found that a reduction in a cross section of an embedded wiring is nonproblematically small.

Further, although according to the embodiment, a titanium nitride film is used as the lower layer metal film, the invention is similarly applicable to a case of using a tungsten film or a tantalum film. By a combination of the abrasive free polishing solution and the polishing pad made of foamed polyurethane resin, not only a copper alloy but also tungsten can be polished at a speed of about 50 nm/min. Therefore, in the case where the upper layer and the lower metal layers are constituted by a combination of a copper alloy and tungsten, there can be formed damascene wirings having extremely small damage.

Further, in the case where the lower metal layer is made of titanium nitride or tantalum nitride, it can be removed also by etching such as using a chemical solution or a dry etching. However, in a structure in which the lower metal layer is interposed between the upper metal layer and the insulating layer, the metal layer is recessed by etching and the reliability of the upper metal layer may be deteriorated. Therefore, when the lower metal layer is removed by etching, the depth of recess needs to be controlled by an amount substantially the same as or within twice as much as the thickness of the lower metal layer from a lower surface of either of the upper layer metal layer and the insulating layer. Further, even when a solution of an alkaline substance is used in place of acid or a salt, the present invention is applicable. Further, the upper metal layer is not limited to copper but tungsten can be used therefor.

According to the embodiment, the supply system of the abrasive free suspension for the upper metal layer is constituted by the mixing vessel, the two vessels of the slurry vessels as necessary and a pump for taking out the abrasive free slurry, and, therefore, there is achieved an advantage in which the system structure is very simple. Further, when hydrogen peroxide solution is added into the same mixing vessel after completely dissolving the polishing materials, the slurry vessel can also be omitted. However, prior to preparing the abrasive free suspension, a plurality of polishing materials need to be prepared by measuring them by predetermined amounts and when the composition of the abrasive free suspension is complicated, the procedure becomes troublesome. In addition thereto, it is troublesome to change measured values in accordance with an amount of the abrasive free suspension to be prepared.

Further, when the slurry supply system and the polishing apparatus are directly connected by pipings, when the abrasive free slurry has been used up, the polishing must be stopped and the abrasive free suspension must newly be prepared. The BTA is difficult to dissolve and accordingly, the stop time period becomes long relatively. In order to avoid this, it is effective to install a buffer tank 128 between the slurry vessel 111 and the platen 126. Such a preceding measurement and preparation of the abrasive free suspension at each time of use are not only troublesome but also produce foreign particles in a clean room when the operation is carried out at inside of the room and therefore, caution is required. In order to avoid this, it is preferable to install the mixing vessel 101 outside of a clean room. In this way, by connecting the abrasive free suspension supply system with one or a plurality of polishing apparatus via the buffer tank, a long time period of continuous operation can be realized and there is achieved an effect of considerable reduction of transportation burden of the abrasive free suspension at inside of a site of use.

Further, although according to the embodiment, there has been shown an example of using a slurry containing abrasive powder for the lower metal layer, the polishing may be carried out by using an abrasive free slurry different from the slurry of the upper metal layer.

Embodiment 2

Figure 2A:
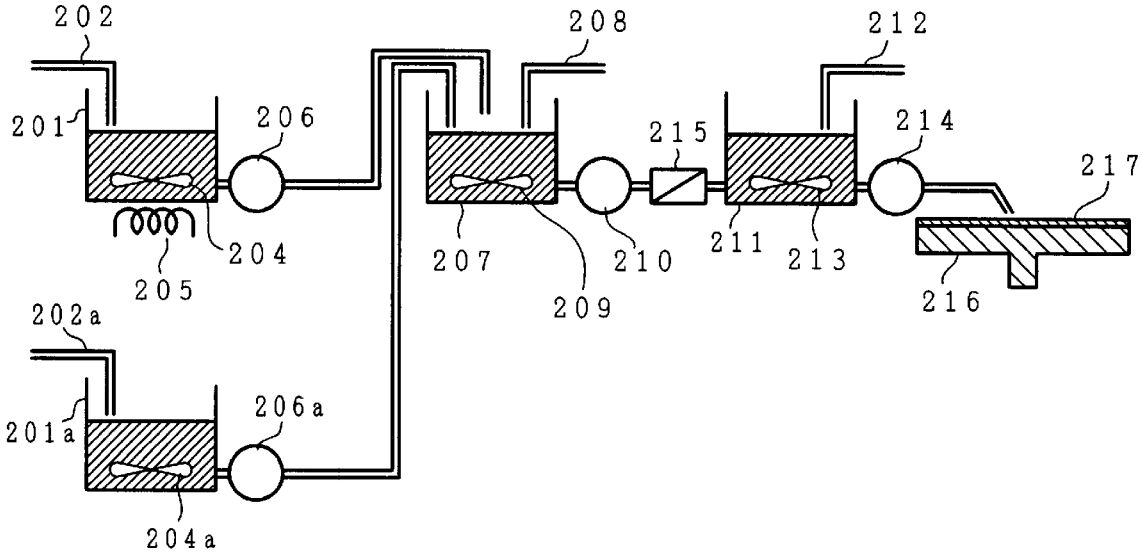
FIGS. 2*a*, 2*b* and 2*c* are views showing a case of preparing an abrasive free slurry by dividing components thereof into a protective layer forming agent and other components.
Figure 2B:
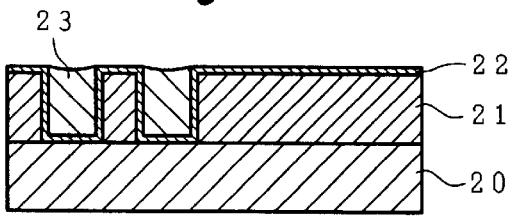
Figure 2C:
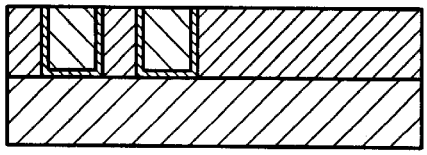

An explanation will be given in reference to FIGS. 2*a*, 2*b* and 2*c*. In FIG. 2*a*, firstly, 100 g of protective layer forming agent is charged into a first mixing vessel 201 and 10 liters of deionized water is charged thereinto via a supply port 202 to thereby dissolve the agent and an aqueous solution having a concentration of about 1 weight percent is prepared. The dissolution is expedited by elevating temperature by using a heater 205. For example, when the water temperature is set to 40° C., the agent can be dissolved easily. Further, properties of the agent are sufficiently stable, and, therefore, there is no concern of denaturing the agent even when the solution temperature is elevated to about 40° C. A total of 160 g of DL-malic acid as organic acid and ammonium salt of organic acid which are respectively measured and mixed previously and 1 liter of deionized water are charged into a second mixing vessel 201*a* to thereby prepare a solution of a polishing material. Next, 1 liter of the solution of the polishing material is taken out from the first mixing vessel 201 and 0.1 liter of the solution of the polishing material is taken out from the second mixing vessel 201*a* respectively by using pumps 206 and 206*a* and are transferred to a first suspension vessel 207. An abrasive free suspension is prepared by adding 5.9 liters of deionized water from a supply port 208 to the suspension vessel 207. After finishing mixing and diluting operation, the abrasive free suspension is transferred to a first slurry vessel 211 via a filter 215 by using a pump 210 and 3 liters of hydrogen peroxide solution is added thereto via a supply port 212 to thereby prepare an abrasive free slurry.

Mixing is performed in mixing vessels 201 and 201*a* and suspension vessel 207 using respective stirrers 204, 204*a* and 207, e.g., of the propeller type.

The first abrasive free slurry is supplied to a polishing apparatus at a rate of 0.2 liter min by using a pump 214 and polishing is carried out by using conditions of 60 rpm, and 200 gf per square cm, a flow rate of the abrasive free slurry of 0.2 liter/min, a polishing pad of IC1000 (commercial name of Rodel Co. Ltd.) of a foamed polyurethane type and temperature of the platen of 22° C. in polishing. A wiring substrate equivalent to that in Embodiment 1 is used and a layer of a copper alloy which is an upper metal layer 23 thereof is polished. The polishing speed is about 240 nm/min and polishing is carried out for 4 min. The polishing corresponds to the excess polishing of about 20%, and as shown by FIG. 2*b*, although the upper metal layer 23 at regions of fabricating LSI on the surface of the wiring substrate has completely been removed, a lower metal layer 22 remains.

Next, the wiring substrate is moved onto a second platen (not illustrated), and the lower metal layer 22 is polished. As a slurry, a suspension QCTT1010 (commercial name of Rodel Co. Ltd.) containing alumina abrasive is mixed with 30% of hydrogen peroxide solution by a volume ratio of 7:3 and added with an aqueous solution of BTA of 2 weight percent to constitute 0.1 weight percent and the slurry is supplied similarly at a flow rate of 0.2 liter/min. According to the slurry, the polishing speed of the copper alloy layer is 20 nm/min or lower. Further, as an effect of adding BTA, the upper metal layer is not etched at all. In contrast thereto, the polishing speed of titanium nitride is about 50 nm/min which remains almost unchanged by addition of BTA. When the wiring substrate 20 is polished by using such a second slurry, as shown by FIG. 2*c*, the upper metal layer 23 in the grooves is not polished and the lower metal layer 13 at portion except the grooves can stably be removed. Even when excessive polishing of 100% is carried out in respect of the lower metal layer 22, an increase of dishing amount of the upper metal layer stays to be about 30 nm and it has been found that a reduction in the cross section of an embedded wiring is nonproblematically small.

According to the embodiment, BTA, which is difficult to dissolve into deionized water, and a solution of other components which are easy to dissolve in deionized water are separately prepared and mixed by a separate vessel, and, accordingly, the embodiment is suitable for preparing a large amount of the abrasive free suspension. However, components other than the BTA must be measured and mixed to constitute predetermined rates before being charged into the mixing vessel.

Embodiment 3

Figure 3A:
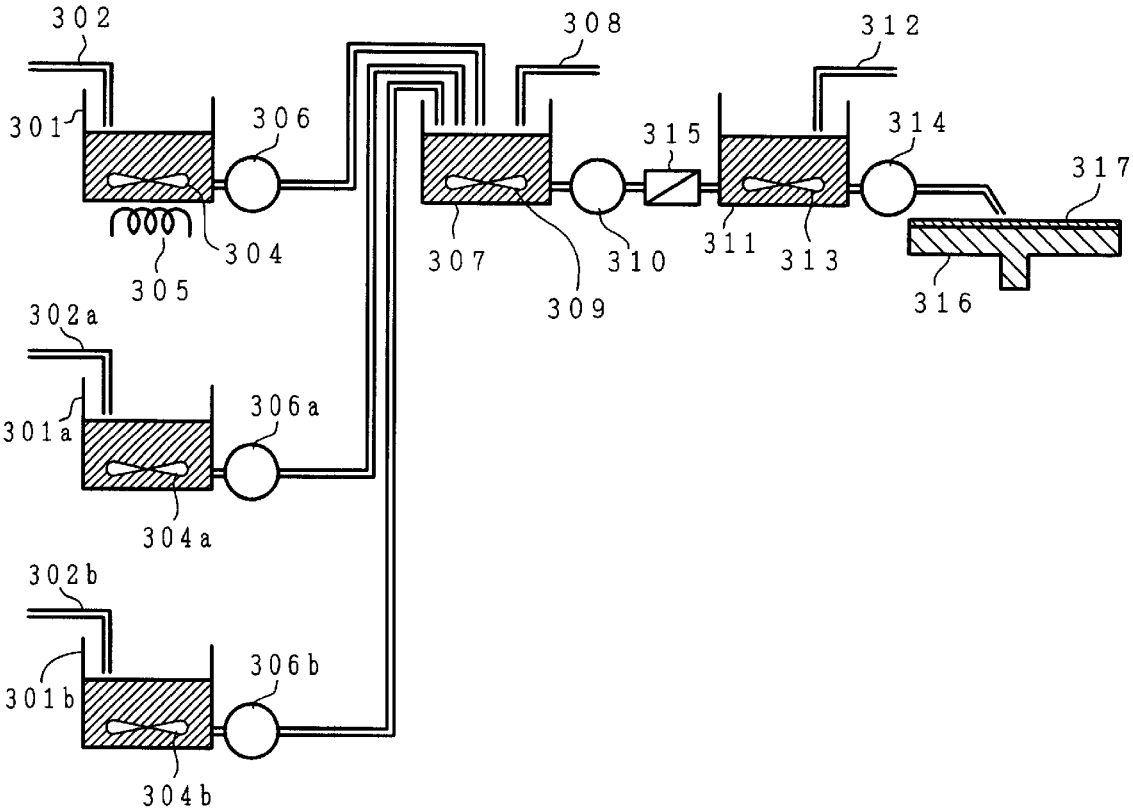
FIGS. 3*a*, 3*b* and 3*c* are views showing a case of preparing an abrasive free slurry from solutions of polishing materials according to respective components.

An explanation will be given in reference to FIGS. 3*a*, 3*b* and 3*c*. First, in a first mixing vessel 301, 100 g of BTA in a solid state as a protective layer forming agent and 4.9 liters of deionized water fed via a supply port 302, are mixed and 2 weight percent of a BTA solution is prepared in a state maintained at 40° C. The solubility limit of BTA at room temperature is 2 weight percent, and, accordingly, it is preferable to elevate solution temperature to 30° C. or higher, using heater 305. Naturally, although the solution may be stirred in the first mixing vessel 301, using, e.g., stirrer 304, the mixing vessel is not limited thereto but other method of expediting the dissolution may be used and other function therefor may be added. The essential point resides in preparing a solution of one component of an abrasive free suspension which is actually used at a concentration higher than an actually used concentration. In a second mixing vessel 301*a*, an aqueous solution of 10 weight percent of DL-malic acid is prepared and stored and in a third mixing vessel 301*b*, an aqueous solution of 10 weight percent of ammonium salt of an organic acid is prepared and stored. Respective supply ports 302*a* and 302*b* are used for supplying deionized water.

As organic acid and its ammonium salt, there are polyacrylic acid, polymethacrylic acid or ammonium salts of these.

An aqueous solution of DL-malic acid is prepared by storing 100 g of the powder in the mixing vessel 301*a* along with 0.9 liter of deionized water and stirring the solution by using a stirrer 304*a*. An aqueous solution of ammonium salt of the organic acid is prepared by dissolving the salt by storing similarly 100 g of the powder in the third mixing vessel 301*b* along with 0.9 liter of deionized water and stirring the solution using stirrer 304*b*. In preparing these solutions, a constant amount which is easy to measure in respect of each component is only mixed with water and efficiency of operation and control of accuracy of solution concentration are promoted. Next, respective solutions of 0.5 liter, 0.15 liter and 0.01 liter are transferred to a suspension vessel 307 at a flow rate of 0.5 liter/min from the first mixing vessel, a flow rate of 0.15 liter/min from the second mixing vessel and a flow rate of 0.01 liter/min from the third mixing vessel by using pumps 306, 306*a* and 306*b* and 6.3 liters of deionized water is added from a supply port 308 to thereby constitute about 7 liters of an abrasive free suspension. Further, the abrasive free suspension is transferred to a slurry vessel 311 by pump 310 via filter 315, and 3 liters of hydrogen peroxide solution having a concentration of 30% is added as an oxidant from a supply port 312 to thereby constitute an abrasive free slurry. Mixing is performed in suspension vessel 307 and slurry vessel 311 using stirrers 309, 313, respectively. Next, the abrasive free slurry is supplied to a polishing system at a rate of 0.2 liter/min via pipings. About 10 liters of the abrasive free slurry is stored in the slurry vessel 311 in one operation and the abrasive free slurry can be supplied simultaneously to several polishing apparatus. Further, when a buffer tank (not illustrated) is interposed between the slurry vessel 311 and the polishing apparatus, even when the abrasive free slurry in the slurry vessel 311 has been used up, the abrasive free slurry can newly be prepared during a time period where the abrasive free slurry remains in the buffer tank, and, accordingly, this constitution is suitable for continuous operation for a long period of time. When the abrasive free slurry is prepared and supplied to the polishing apparatus in this way, the accuracy of a flow rate control by a pump can be maintained at a sufficient value of about plus or minus 5%. However, transportation of solution by a tube pump produces a pulsating flow, and, therefore, it is preferable to alleviate a dispersion in a concentration by mixing the solution in each vessel by a stirrer as necessary. According to the embodiment the abrasive free suspension vessel, the slurry vessel and the buffer tank plays such a role.

In the polishing apparatus, an upper metal layer of a wiring substrate equivalent to that in Embodiment 1 is polished by using conditions of the platen speed of 60 rpm, the polishing pressure of 200 gf per square cm, the flow rate of the slurry of 0.2 liter/min, the polishing pad of IC1000 (commercial name of Rodel Co. Ltd.) made of foamed polyurethane resin and the platen temperature of 22° C. in polishing. The polishing speed is about 240 nm/min and polishing is carried out for 4 min. This operation corresponds to excess polishing of about 20% and as shown by FIG. 3*b*, an upper metal layer 33 in regions for fabricating LSI on the surface of a wiring substrate 30 is completely removed. A lower metal layer 32 remains.

Figure 3B:
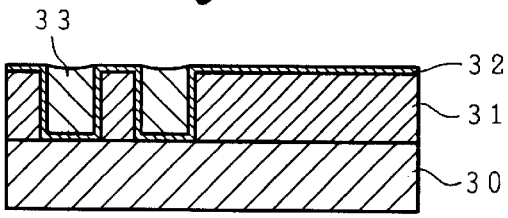
Figure 3C:
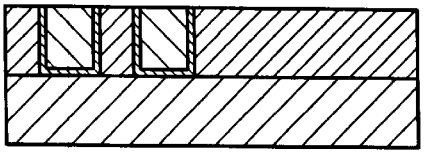

Next, by moving the wiring substrate onto a second platen (not illustrated), the lower metal layer 32 shown by FIG. 3*b* is polished. A slurry is prepared by mixing a suspension QCTT1010 (commercial name of Rodel Co. Ltd.) containing alumina abrasive with 30% of hydrogen peroxide solution by a volume ratio of 7:3 and further adding an aqueous solution of 2 weight percent of BTA to constitute 0.1 weight percent and supplied similarly at a flow rate of 0.2 liter/min. According to the slurry, the polishing speed of the copper alloy layer is 20 nm/min or lower. Further, as an effect of adding BTA, the upper metal layer is not etched at all. In contrast thereto, the polishing speed of titanium nitride is about 50 nm/min which remains almost unchanged by adding BTA. When the wiring substrate 30 is polished by using such a second slurry, as shown by FIG. 3*c*, the upper metal layer 33 in the grooves is not polished at all and the lower metal layer 32 at portions except the grooves can stably be removed. Even when excessive polishing of 100% is carried out in respect of the lower metal layer 32, an increase of dishing of the upper metal layer stays at about 20 nm and it has been found that a reduction in a cross section of an embedded wiring is nonproblematically small.

Embodiment 4

An explanation will be given in reference to FIGS. 4*a*, 4*b* and 4*c*. In a first mixing vessel 401, 100 g of BTA is charged as a first protective layer forming agent and 4.9 liters of deionized water is added via a supply port 402 to thereby prepare about 2 weight percent of BTA solution. Heater 405 and stirrer 404 are used to effectuate the solution, as discussed previously.

Similarly, in a second mixing vessel 401*a*, deionized water is charged via a supply port 402*a* to thereby store an aqueous solution of 10 weight percent of DL-malic acid (the solution is mixed using stirrer 404*a*) and similarly, in a third mixing vessel 401*b*, deionized water is introduced via a supply port 402*b* to thereby store an aqueous solution of 10 weight percent of a complex salt of an organic acid (the solution is mixed using stirrer 404*b*). In the second and the third mixing vessels, in order to store materials respectively having high solubilities, the solutions are prepared by storing, e.g., 100 g of powder in the second mixing vessel 401*b* along with 0.9 liter of deionized water and stirring them (using stirrer 404*b*). In preparing these solutions, constant amounts of purchase units may only be mixed with water with regard to respective components, and efficiency of operation and concentration accuracy of solutions are promoted. Next, respective solutions of 0.5 liter, 0.15 liter and 0.01 liter are transferred to a first abrasive free suspension vessel 407 (having stirrer 409) at a flow rate of 0.5 liter/min from the first mixing vessel 401 via a constant volume pump 406, at a flow rate of 0.15 liter/min from the second mixing vessel 401*a* via a pump 406*a* and at a flow rate of 0.01 liter/min from the third mixing vessel 401*b*, and 6.3 liters of deionized water is added from a supply port 408 to thereby constitute an abrasive free suspension.

Further, the abrasive free suspension is transferred to a first slurry vessel 411 by pump 410 via a filter 415 having a mesh of 1 micrometer, and 3 liters of hydrogen peroxide solution having a concentration of 30% is added as an oxidant via a supply port 412 to thereby constitute an abrasive free slurry. Next, the abrasive free slurry is supplied at a rate of 0.2 liter/min to a polishing apparatus via a buffer tank (not illustrated) and pipings. Further, flow rates of solutions of the respective polishing materials are separately controlled by using constant volume pumps and flow controllers 420, 420*a* and 420*b*. Next, the abrasive free slurry is supplied to a first platen 416 by using a pump 414.

Further, respective solutions of 2 liters, 0.15 liter and 0.05 liter are transferred to a second abrasive free suspension vessel 407*a* (having stirrer 409*a*) at a flow rate of 0.5 liter/min from the first mixing vessel 401 via the pump 406, at a flow rate of 0.15 liter/min from the second mixing vessel 401*a* via the pump 406*a* and at a flow rate of 0.05 liter/min from the third mixing vessel 401*b* via the pump 406*b* and 4.8 liters of deionized water is added via a supply port 408*a* to thereby constitute an abrasive free suspension. Further, the abrasive free suspension is transferred to a second slurry vessel 411*a* (having stirrer 413*a*), 3 liters of hydrogen peroxide solution as an oxidant is added via a supply port 412*a* and 1 liter of a dispersing solution SCE (commercial name of Cabot Co. Ltd.) of silica abrasive powder is added via a filter of a mesh of 10 micrometers installed at a supply port 412*b* to thereby constitute a slurry containing abrasive powder. Although purchase cost of the dispersing solution SCE is more expensive than the silica powder itself, a concentration of abrasive powder in the SCE solution is about 15%, in the meantime, when mixed with the abrasive free suspension, the concentration is about 2 weight percent and therefore, the cost can more or less be saved. When the dispersing solution SCE is mixed with the abrasive free solution, aggregation may be caused over time; however, these are mixed immediately before a polishing apparatus and are used within about 6 hours after mixing them, and, therefore, polishing is carried out before causing aggregation, and producing scratches can be suppressed. Further, it seems that there is an effect of making difficult the aggregation also owing to a low concentration of abrasive powder. Further, flow rates of solutions of the respective polishing materials are separately controlled by using flow controllers 421, 421*a* and 421*b*. Since the dispersing solution SCE of silica abrasive grains includes the abrasive powder, it is difficult to use a flow controller and accordingly, only flow rate control of the pump is used. Next, the slurry with silica abrasive powder is supplied to a second platen 416*a* at a rate of 0.2 liter/min via a pump 414*a*.

At the first platen 416 of the polishing apparatus, an upper metal layer of a wiring substrate equivalent to that in Embodiment 1 is polished using polishing pad 417, by using conditions of the relative speed of 60 rpm, the polishing pressure of 200 gf per square centimeter, the flow rate of the abrasive free slurry of 0.2 liter/min, the polishing pad of IC1000 (commercial name of Rodel Co. Ltd.) of foamed polyurethane resin type and the platen temperature of 22° C. in polishing. The polishing speed is about 240 nm/min and polishing of 4 min is carried out. The polishing corresponds to excessive polishing of about 20% and an upper metal layer in regions for fabricating LSI on the surface of the wiring substrate has completely been removed. A lower metal layer is not polished to remain.

Figure 4A:
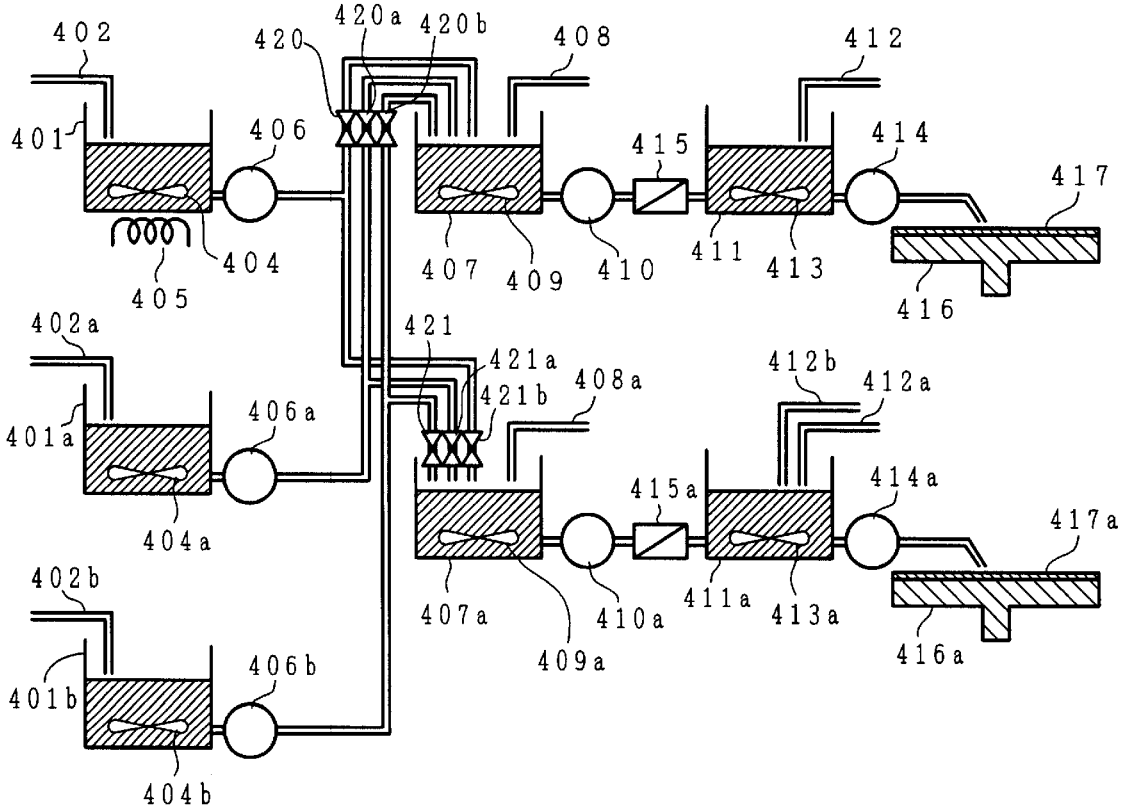
FIGS. 4*a*, 4*b* and 4*c* are views showing a case of preparing solutions of polishing materials according to respective components and supplying an abrasive agent to a first and a second platen.
Figure 4B:
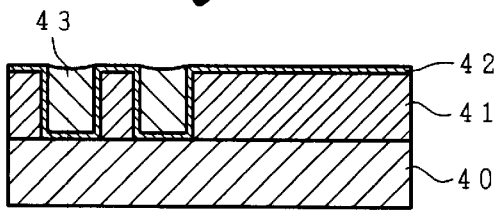
Figure 4C:
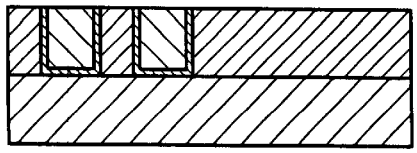

Next, the wiring substrate 10 is moved onto the second platen 416*a* and a lower metal layer 42 is polished using polishing pad 417*a*, as shown by FIG. 4*c* by using the same conditions except the slurry. The polishing pressure is 200 g per square cm and the polishing pad uses IC1000 (commercial name of Rodel Co. Ltd.) of foamed polyurethane resin type. The polishing speed of a titanium nitride film is 60 nm/min and the film has completely been removed in a polishing time period of 1 min. When the slurry containing abrasive powder is used (the slurry includes more than 1 weight percent of abrasive powder), a concentration of BTA is increased to about twice as much as that in conditions of a case of polishing a copper alloy and therefore, the polishing speed of the copper alloy is 10 nm/min or lower and a depth of dishing is 20 nm or smaller at a wiring having a width of 10 μm. Further, according to the embodiment, a slurry for a barrier layer can be produced substantially by the supply system and accordingly, the embodiment is further effective in reducing cost of the slurry. Further, as a dispersing solution of abrasive powder, a dispersing solution of alumina abrasive may be used. Further, UNASOL-610 (commercial name of Universal Photonics Co. Ltd., abrasive concentration; 40% or higher) or the like is on sale. Major components of these abrasive dispersing solutions are abrasive powder and dispersants thereof and a user dilutes them by water until a desired concentration of abrasive powder is obtained and the dispersing solution is used in polishing mainly for achieving mechanical effect. For example, UNASOL-610 which is an alumina dispersing solution is particularly suitable for polishing Ta and the SCE solution is used in polishing Si or $SiO_2$.

Embodiment 5

An explanation will be given in reference to FIGS. 4*a*, 4*b* and 4*c*.

In the first mixing vessel 401, 100 g of BTA is charged as a first protective forming agent and 5 liters of deionized water is introduced via the supply port 402 to thereby prepare an aqueous solution of about 2 weight percent of BTA.

Similarly, in the second mixing vessel 401*a*, deionized water is charged via the supply port 402*a* and an aqueous solution of 10 weight percent of DL-malic acid is stored, similarly, deionized water is introduced into the third mixing vessel 401*b* via the supply port 402*b* and an aqueous solution of 10 weight percent of complex salt of an organic acid is stored. According to the second and the third mixing vessels, in order to store materials respectively having high solubilities, the solution is prepared by storing 100 g of powder in the second mixing vessel 401*a* along with 0.9 liter of deionized water and stirring them. In preparing these solutions, constant amounts of purchase units may be mixed with water with regard to respective components, and efficiency of operation and accuracy of concentration of solution are promoted.

Next, respective solutions of 2.0 liters, 0.15 liter and 0.05 liter are transferred to the first abrasive free suspension vessel 407 at a flow rate of 0.5 liter/min from the first mixing vessel 401 via the pump 406, at a flow rate of 0.15 liter/min from the second mixing vessel 401*a* via the pump 406*a* and at a flow rate of 0.05 liter/min from the third mixing vessel 401*b* and 4.3 liters of deionized water is added from the supply port 408 to thereby constitute an abrasive free suspension. Further, the abrasive free suspension is transferred to the first slurry vessel 411 via the filter 415 having the mesh of 1 micrometer and 3 liters of hydrogen peroxide solution having a concentration of 30% is added as an oxidant via the supply port 412 to thereby constitute an abrasive free slurry. Next, the abrasive free slurry is supplied at a rate of 0.2 liter/min to a polishing apparatus via a buffer tank (not illustrated) and pipings. Further, flow rates of solutions of respective polishing materials are respectively controlled by using the pumps and the flow controllers 420, 420*a* and 420*b*. Next, the abrasive free slurry is supplied to the first platen 416 via the pump 414.

Further, respective solutions of 5 liters, 0.15 liter and 0.05 liter are transferred to the second abrasive free suspension vessel 407*a* at a flow rate of 1 liter/min from the first mixing vessel 401 via the constant volume pump 406, a flow rate of 0.15 liter/min from the second mixing vessel 401*a* via the constant volume pump 406*a* and at a flow rate of 0.05 liter/min from the third mixing vessel 401*b* and 1 liter of deionized water is added via the supply port 408*a* to thereby constitute an abrasive free suspension. Further, the abrasive free suspension is transferred to the second slurry vessel 411*a* via the filter 415*a* having the-mesh of 1 micrometer and 3 liters of hydrogen peroxide solution as an oxidant is added via the supply port 412*a* to thereby constitute an abrasive free slurry. Further, flow rates of solutions of respective polishing materials are respectively controlled by using the flow controllers 421, 421*a* and 421*b*. Next, the abrasive free slurry is supplied to the second platen 416*a* at a rate of 0.2 liter/min by using a constant volume pump 414*a*. Further, although according to the above-described embodiments, a filter for removing foreign matters in an abrasive free slurry is installed at a stage prior to adding hydrogen peroxide solution, when the filter is made of a material which is difficult to be oxidized such as a fluoropolymer or the like or when a consideration is given to sufficiently increasing a frequency of interchanging the filter, the filter can be installed also immediately before being injected on the platen.

The lower metal layer 42 is a tantalum nitride film having a thickness of 50 nm, in a wiring substrate equivalent to that in Embodiment 1, and according to the first platen 416 of the polishing apparatus, the upper metal layer 43 is polished by using conditions of the rotation speed of 55 through 60 rpm, the polishing pressure of 200 gf per square cm, the flow rate of the abrasive free slurry of 0.2 liter/min, the polishing pad of IC1000 (commercial name of Rodel Co. Ltd.) of foamed polyurethane resin type and the platen temperature of 22° C. in polishing. The polishing speed of a copper alloy in the upper metal layer 43 is about 90 nm/min and polishing of 11 min is carried out. This corresponds to excess polishing of about 20% and as shown by FIG. 4*b*, the upper metal layer 43 in regions for fabricating LSI on the surface of the wiring substrate 40 has completely been reduced. The abrasive free slurry does not react with the copper alloy at all (does not etch the copper alloy), and, accordingly, after finishing the polishing, surfaces of the polished upper metal layer 43 and the surrounding lower metal layer 42 substantially constitute the same plane. The lower metal layer 42 is not polished but remains.

Next, the wiring substrate 40 is moved onto the second platen 416*a* and the lower metal layer 42 is polished as shown by FIG. 4*c* by using the same conditions except the abrasive suspension. The polishing pressure is 140 gf per square cm and in place of a polishing pad, there is used a grindstone in which alumina abrasive having an average particle size of 0.3 micrometers is fixed by novolak resin or the like. The grindstone is featured in that it is brittle since a density of alumina particles is 90% or more and it is provided with a characteristic in which particles are liable to detach and therefore, scratches are hardly produced. The polishing speed of a tantalum nitride film is about 20 nm/min and the film has completely been removed in a polishing time period of 1.5 min. The second abrasive free slurry injected to the grindstone is provided with a high concentration of BTA and does not polish the copper alloy. In addition thereto, in place of the polishing pad made of polymer resin, the grindstone with alumina abrasive is used and therefore, flatness after polishing has been extremely excellent. The depth of dishing of the copper alloy layer is 10 nm or smaller with a wiring having a width of 10 μm. According to the embodiment, scratches may be caused when foreign matters mix from outside in using the grindstone and accordingly, in the case in which there is a concern that the scratches hamper fabrication of an upper level wiring, the surface is further polished by a normal method of using a slurry including abrasive and a polishing pad which does not include abrasive to thereby remove the scratches. A slurry may use either of abrasive suspension of alumina and silica on sale. Although the scratches are easy to remove by the latter, the polishing speed of $SiO_2$ is relatively large and caution is required in controlling the polishing amount. As the polishing pad, a laminated pad of a hard upper layer on a lower layer softer than the upper layer can be used. For example, there are XHGM1158 and IC1400 (both are commercial names of Rodel Co. Ltd.) and so on.

Further, although in FIG. 4*a*, respective ones of takeout ports from the mixing vessels 401, 401*a* and 401*b* and the pumps 406, 406*a* and 406*b* are installed and after branching them, the solutions are supplied to the abrasive free solution vessels 407 and 407*a* by using the flow controllers 420, 420*a*, 420*b*, 421, 421*a* and 421*b*, the solutions may be supplied separately to the abrasive free solution vessels 407 and 407*a* by using pluralities of takeout ports from the respective mixing vessels, 401, 401*a* and 401*b*, pumps capable of controlling flow rates (not illustrated) or flow controllers (not illustrated).

Further, according to the supply system shown by the above-described embodiments, only flow controllers may be used in place of pumps, when height differences are provided among the mixing vessels, the abrasive free solution vessels and so on.

Further, although according to Embodiments 4 and 5, the first, the second and the third mixing vessels are prepared, other than the first vessel, a second vessel for containing a mixture solution by combining the second the third vessels into one vessel (that is, the third vessel is not used) and a solution in the first vessel and a solution in the second vessel may pertinently be mixed to thereby carry out the polishing or the grinding operation.

Embodiment 6

An explanation will be given of a case to which the present invention is applied for forming wirings on a substrate for a semiconductor integrated circuit including semiconductor elements. The apparatus and the method shown by FIG. 3*a* are used for supplying slurries. An explanation will be given on a fabrication procedure of the integrated circuit substrate in reference to FIG. 5 through FIG. 9. Incidentally, although according to the embodiment, a description will be given of a case of forming a transistor as a device, in the case of forming a dynamic random access memory, mainly steps of forming a capacitor is added and steps of extracting electrodes from each element and steps thereafter are substantially equivalent.

Preparation of a slurry and supply thereof to a platen are the same as those in Embodiment 3 and therefore, only the outline thereof is described in this embodiment. In the first mixing vessel 301, as a protective layer forming agent, 100 g of BTA in a solid state and 4.9 liters of deionized water fed via the supply port 302 are mixed, and an aqueous solution of 2 weight percent of BTA is prepared in a state maintained at 40° C. It is preferable to elevate temperature of the BTA aqueous solution to 25° C. or higher. An aqueous solution of 10 weight percent of DL-malic acid is prepared and contained in the second mixing vessel 301*a* and an aqueous solution of 10 weight percent of ammonium salt of an organic acid is prepared and contained in the third mixing vessel 301*b*. The respective supply ports 302*a* and 302*b* are used for supplying deionized water.

As organic acid or its ammonium salt, polyacrylic acid, polymethacrylic acid or ammonium salts of these are suitable.

Next, respective solutions of 0.5 liter, 0.15 liter and 0.01 liter are transferred to the suspension vessel 307 at a flow rate of 0.5 liter/min from the first mixing vessel, at a flow rate of 0.15 liter/min from the second mixing vessel and at a flow rate of 0.01 liter/min from the third mixing vessel by using the pumps 306, 306*a* and 306*b*, and 6.3 liters of deionized water is added to thereby constitute about 7 liters of an abrasive free suspension. Further, the abrasive free suspension is transferred to the slurry vessel 311 and 3 liters of hydrogen peroxide solution having a concentration of 30% is added as an oxidant to thereby constitute an abrasive free slurry. Next, the abrasive free slurry is supplied to the polishing apparatus at a rate of 0.2 liter/min via pipings. About 10 liters of the abrasive free slurry is contained in the slurry vessel 311 in one operation and the abrasive free slurry can be supplied simultaneously to several of the polishing apparatus. Further, when a buffer tank (not illustrated) is interposed between the slurry vessel 311 and the polishing apparatus, even when the abrasive free solution in the slurry vessel 311 has been used up the abrasive free slurry can be prepared newly during a time period in which the abrasive free slurry remains in the buffer tank and accordingly, the constitution is suitable for continuous operation for a long period of time. When the abrasive free slurry is prepared and supplied to the polishing apparatus in this way, the accuracy of flow rate control by pumps can be maintained at a sufficient value of about plus or minus 5%. However, transportation of solution by a tube pump produces a pulsating flow and accordingly, it is preferable to alleviate a dispersion of a concentration by mixing the solution by a stirrer or the like in each of the vessels as necessary. According to the embodiment, the abrasive free solution vessel, the abrasive suspension vessel and the buffer tank serves the role.

As polishing conditions, there are used conditions of the rotational speed of a platen of 18 inch diameter of 60 rpm, the polishing pressure of 200 gf per square cm, the flow rate of the abrasive free slurry of 0.2 liter/min and the polishing pad of IC1000 (commercial name of Rodel Co. Ltd.) made of foamed polyurethane resin unless specified otherwise and the temperature of the platen of 22° C. in polishing. The polishing speed of a copper alloy at this occasion is about 240 nm/min.

Figure 5:
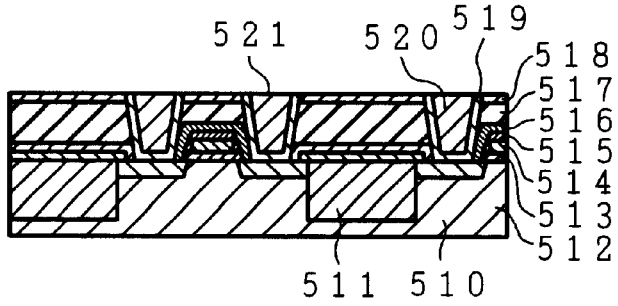
FIG. 5 is a view showing a procedure for forming a copper multilevel wiring for a semiconductor integrated circuit.

In parallel therewith, as shown by FIG. 5, an embedded insulating layer 511 for separating devices is formed on the surface of a wiring substrate 510 comprising a silicon substrate of 6 inch diameter including a p-type impurity. The surface is planarized by polishing using an alkaline abrasive suspension including silica abrasive and ammonia. Next, a diffusion layer 512 of an—type impurity is formed by ion implantation and heat treatment and a gate insulating film 513 is formed by a thermal oxidation process. Next, a gate 514 comprising polycrystalline silicon or a laminated film of a high melting point metal and polycrystalline silicon is fabricated to form. On the surface, a device protecting film 515 comprising silicon oxide or a silicon oxide film added with phosphorus and a contamination preventive film 516 comprising a silicon nitride film for preventing invasion of contaminant substances from outside are deposited. Further, a planarization layer 517 comprising silicon oxide (described as p-TEOS) formed by a plasma chemical vapor deposition process (described as plasma CVD process) using tetraethoxysilane (described as TEOS) as a raw material, is formed by a thickness of about 1.5 micrometers and by thereafter polishing the insulating film by a thickness of about 0.8 micrometer by using a polishing apparatus (not illustrated) for the above-described insulating film the surface is flattened. Further, the surface is coated with a second protective layer 518 comprising silicon nitride for preventing diffusion of copper. Successively, contact holes 519 for connecting with devices are opened at predetermined positions and a laminated layer film 520 of titanium and titanium nitride and a tungsten layer 521 which are used for both adhesion and prevention of contamination, are formed and portions other than the holes are removed by polishing to thereby form a so-to-speak plug structure.

The laminated layer film 520 of titanium and titanium nitride is formed by a reactive sputtering process or a plasma CVD process. The tungsten layer can be formed also by using a sputtering process or a CVD process. In respect of sizes of the contact hole 519, the diameter is about 0.25 micrometer or smaller and the depth is 0.8 through 0.9 micrometer. Further, when an element for the above-described dynamic random access memory is formed, the depth is further increased and may reach 1 micrometer or more. A thickness of the laminated layer film 520 is set to about 50 nm at plane portions. A thickness of the tungsten layer 521 is set to about 0.6 micrometer. This is for facilitating polishing of tungsten by sufficiently filling the contact hole and improving the flatness of the surface of film. Further, in polishing the laminated layer film of tungsten and titanium nitride, a polishing suspension of SSW-2000 (commercial name of Cabot Co. Ltd.) containing silica abrasive, and hydrogen peroxide as an oxidant are mixed to use as an slurry. The above-described conditions are used for other polishing conditions except the slurry. The both are polished by using the same platen (not illustrated) in a first polishing apparatus.

Figure 6:
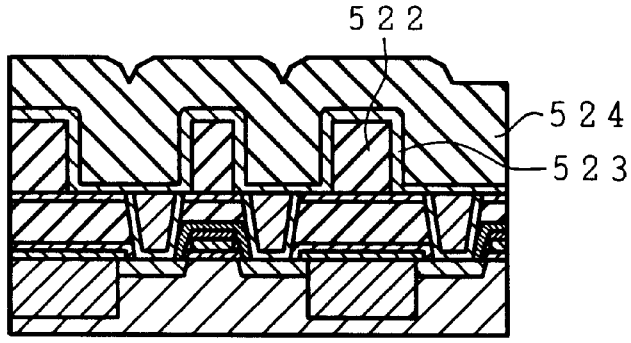
FIG. 6 is a view showing the procedure for forming the copper multilevel wiring for a semiconductor integrated circuit.

Next, as shown by FIG. 6, a first interlevel insulating layer 522 is formed, grooves for wirings are formed and a first lower metal layer 523 having a thickness of 50 nm comprising titanium nitride and a copper film as a first upper metal layer 524 are formed. In this case, a thickness of the first interlevel insulating film 522 is set to 0.5 micrometer. Further, although a publicly-known reactive dry etching technology is used for forming the grooves, the second protective layer 518 comprising silicon nitride serves also as a stopper of etching. The etching rate of silicon nitride is substantially ⅕ of that of silicon oxide and therefore, the thickness is set to about 100 nm. For the first upper metal layer 524, a copper layer having a thickness of 0.7 micrometer is formed by a sputtering process, filled into the grooves by heat treatment at about 450 degree C.(centigrade).

Figure 7:
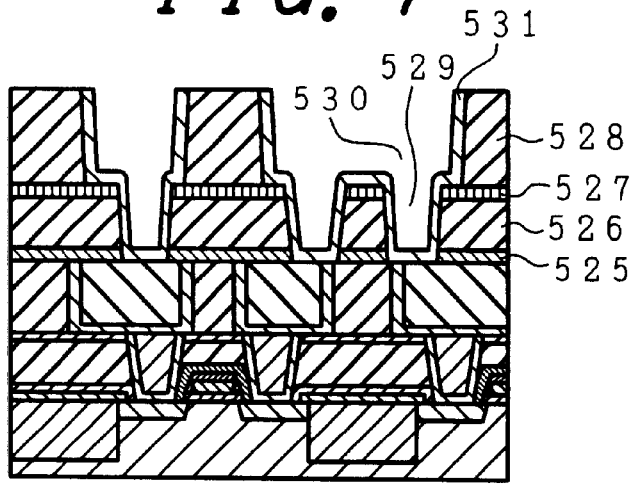
FIG. 7 is a view showing the procedure for forming the copper multilevel wiring for a semiconductor integrated circuit.

Further, as shown by FIG. 7, the first upper metal layer 524 is polished by using the abrasive free slurry supplied from the apparatus shown by FIG. 3*a* and a second polishing apparatus (not illustrated) which is different from the first polishing apparatus for polishing the tungsten layer 521 at the contact hole portion and the laminated layer film 520. This is for avoiding contamination of copper at the contact hole portion. Further, the first lower metal layer 523 is polished by using an abrasive agent in which 0.2 weight percent of BTA is added to a mixture solution of a suspension of SSW-2000 (commercial name of Cabot Co. Ltd.) including silica abrasive and hydrogen peroxide, and a second platen (not illustrated) of the second polishing apparatus. In this case, in polishing the first lower metal layer 523, as the polishing pad, there is used IC1400 (commercial name of Rodel Co. Ltd.) having a laminated layer structure comprising an upper layer of foamed polyurethane resin and a lower layer of a soft resin layer. Although since the polishing pad is slightly soft, in view of the planarization effect, it is slightly inferior to the pad of IC1000, mentioned above, damage (scratching) by polishing is less and there is achieved an advantage of promoting the yield of wirings. It is for avoiding generating scratches because there existed a complicated structure of active elements and wirings at a lower levels as in this embodiment, resulting in scratches liable to be made since the mechanical strength is degraded. A second contamination preventive film 525 comprising silicon nitride is formed on the polished surface by a plasma CVD process. A thickness of the layer is set to 20 nm.

Further, in the case in which various active elements are formed on the surface of the wiring substrate 510 as in this embodiment and in accordance therewith, large and complicated step differences on the surface are caused, even after the planarization layer 517 has been polished, the surface of the first interlevel insulating layer 522 is not sufficiently planarized and there is a case in which a shallow and wide recess having the depth of about 5 nm and the width of, for example, 5 micrometers remains. When the characteristic of the abrasive free slurry is extremely excellent and dishing or the like are not caused at all, there is a case in which even at such a shallow recess, a portion where the first upper metal layer 524 is not polished yet, is produced. In such a case, when a concentration of BTA added to the slurry comprising SSW-2000 and hydrogen peroxide solution is adjusted and a characteristic capable of polishing also the first upper metal layer 524 to some degree is provided, even when the portions where the upper metal layer is not polished are slightly generated, in polishing the first lower metal layer 523, the portions where the first upper metal layer 524 is not polished can stably be removed.

Next, as a second interlayer insulating film 526, a p-TEOS film having a thickness of 0.7 micrometer is formed and the surface is polished to planarize by a CMP method using the above-described alkaline slurry by a depth of 0.2 micrometer. The planarization is for resolving step differences caused in the step of polishing the first upper metal layer 524. Next, as a third contamination preventive film 527, a plasma CVD silicon nitride film having a thickness of 0.2 micrometer is formed and as a third interlevel insulating film 528, a p-TEOS film having a thickness of 0.7 micrometer is formed. Next, first via holes 529 and grooves 530 for second wirings are formed by publicly-known photolithography technology and reactive dry etching to thereby expose the surface of the first upper metal layer 524. In forming such a groove pattern of a two-stage structure, the silicon nitride film 527 operates as a stopper of etching. A titanium nitride film having a thickness of 50 nm is formed by a plasma CVD process as a second lower metal layer 531 at the grooves having the two-stage structure formed in this way.

Figure 8:
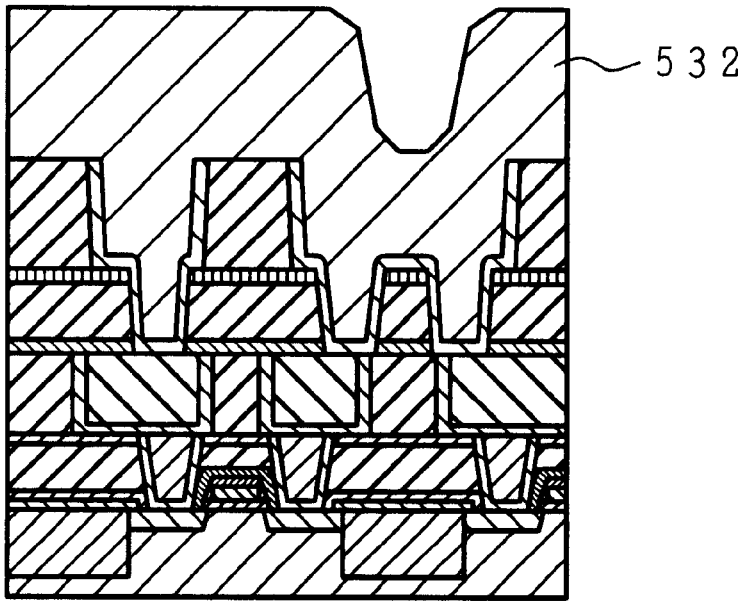
FIG. 8 is a view showing the procedure for forming the copper multilevel wiring for a semiconductor integrated circuit.
Figure 9:
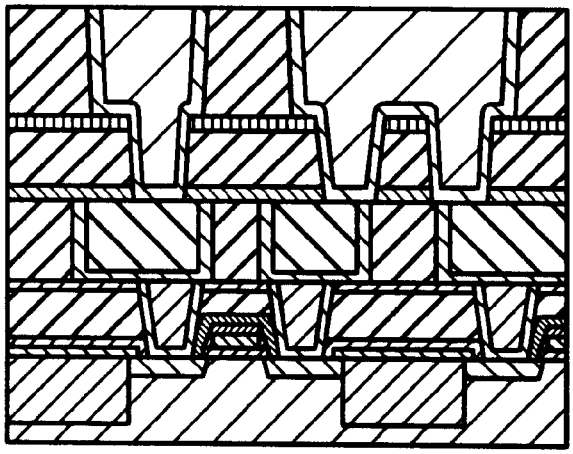
FIG. 9 is a view showing the procedure for forming the copper multilevel wiring for a semiconductor integrated circuit.

Further, as shown by FIG. 8, a second upper metal layer 532 is formed by a copper sputtering process by a thickness of 1.2 micrometers and embedded by heat treatment at 450° C. The second upper metal layer 532 is planarized by polishing for five minutes corresponding to excess polishing of about 20% by using the abrasive free slurry supplied from the apparatus shown by FIG. 3*a* and the second polishing apparatus and the second lower metal layer 531 is polished by the polishing speed of about 200 nm/min by the above-described slurry using SSW-2000 added with BTA and hydrogen peroxide to thereby form two-level wirings of copper using the damascene process and a dual damascene process as shown by FIG. 9. As the polishing conditions, there are used conditions equivalent to those used in polishing the first upper metal layer and the first lower metal layer except the polishing time. As has been described above, when the method of polishing the insulating film and polishing the copper alloy and laminated layer films of two stages is used, many layers of wirings can be formed with high yield while excellently maintaining the planarity of the surface of the respective insulating film and the metal layer.

According to the present invention, by transporting only raw materials or raw material solutions, the volume of transportation can be reduced to about 10% and the cost of metal polishing can significantly be reduced.

Further, according to the present invention, solids or solutions having individual chemical components can be stored as solids or solutions mixed with components having low reactivities, and an abrasive free slurry can be prepared and supplied to a polishing apparatus immediately before use, and, accordingly, the present invention is advantageous in promoting polishing characteristic and promoting stability.

Many different embodiments of the present invention may be constructed without departing from the spirit and scope of the invention. It should be understood that the present invention is not limited to the specific embodiments described in this specification. To the contrary, the present invention is intended to cover various modifications and equivalent arrangements included within the spirit and scope of the claims.

What is claimed is:

1. A polishing apparatus capable of using a liquid that is comprised of abrasive free suspension for metal polishing, comprising:

a polishing unit;

a mixture unit, which mixes polishing materials having a condensed concentration of said abrasive free suspension so as to prepare said liquid having a diluted concentration of said abrasive free suspension, supplied to the polishing unit, the mixture unit being installed in the vicinity of the polishing unit, wherein a heater is installed in the mixture unit;

a first supply structure to supply said condensed concentration of said suspension to said mixture unit; and a second supply structure to supply a diluent to said mixture unit, whereby said diluted concentration of said abrasive free suspension is prepared in said mixture unit.

2. A polishing apparatus according to claim 1, further comprising supply structure to supply the polishing materials to the mixture unit, wherein the supply structure includes supply structure to supply an oxidizer.

3. A polishing apparatus according to claim 1, wherein there is not a reservoir, where the liquid is retained, between the polishing unit and the mixture unit.

4. The polishing apparatus according to claim 1, wherein a stirrer is installed in the mixture unit.

5. The polishing apparatus according to claim 1, further comprising a buffer unit installed between the polishing unit and the mixture unit, for temporarily retaining the liquid, whereby liquid from the buffer unit can be used to avoid stopping polishing to prepare new liquid when abrasive free slurry has been used up.

6. The polishing apparatus according to claim 1, wherein a filter is installed between the polishing unit and the mixture unit.

7. The polishing apparatus according to claim 6, wherein a mesh size of the filter is not more than one micrometer.

8. A polishing apparatus according to claim 1, further comprising a first supply structure and a second supply structure respectively for supplying a first polishing material and a second polishing material to the mixture unit, the first and second polishing materials being components of said liquid.

9. A polishing apparatus according to claim 8, wherein said second supply structure is a supply structure for supplying an oxidizer to the mixture unit.

10. A polishing apparatus capable of using a liquid that is comprised of abrasive free suspension for metal polishing, comprising:

a polishing unit;

a mixture unit, which mixes polishing materials having a condensed concentration of said abrasive free suspension, so as to prepare a diluted concentration of said abrasive free suspension, for supplying the diluted concentration of the abrasive free suspension to a mixture vessel;

the mixture vessel, which mixes polishing materials so as to prepare said liquid, supplied to the polishing unit;

piping between the polishing unit and the mixture vessel, directly connecting the polishing unit to the mixture vessel;

a first supply structure to supply said condensed concentration of said suspension to said mixture unit; and a second supply structure to supply a diluent to said mixture unit, whereby said diluted concentration of said abrasive free suspension is prepared in said mixture unit.

11. A polishing apparatus according to claim 10, wherein there is not a reservoir, where the liquid is retained, between the polishing unit and the mixture vessel.

12. A polishing apparatus according to claim 10, wherein said mixture unit is a vessel in flow communication with said piping.

13. A polishing apparatus comprising:

a polishing unit for polishing an object;

a first vessel;

a first supplying pipe for supplying a first polishing material, which is comprised of abrasive free suspension for metal polishing having a condensed concentration of said suspension, to the first vessel;

a second supplying pipe for supplying a second polishing material to be mixed with the first polishing material;

a mixture unit in which is mixed the first polishing material and the second polishing material to make a liquid which is comprised of abrasive free suspension for metal polishing, the apparatus including a further supplying pipe for supplying the first polishing material from the first vessel to the mixture unit, the mixture unit being installed in the vicinity of the polishing unit;

a third supplying pipe to supply the liquid having a diluted concentration of said suspension to the polishing unit; and a fourth supplying pipe for supplying a diluent for said abrasive free suspension for metal polishing to provide said diluted concentration of said suspension.

14. A polishing apparatus according to claim 13, wherein there is not a reservoir, where the liquid is retained, between the mixture unit and the polishing unit.

15. A polishing apparatus according to claim 13, wherein there is a continuous flow communication between the mixture unit and the polishing unit.

16. A polishing apparatus according to claim 13, wherein the second supplying pipe is adapted to supply an oxidizer to the mixture unit.

17. A polishing apparatus according to claim 13, wherein said fourth supplying pipe is for supplying said diluent to said first vessel.

18. A plant comprising:

a clean room;

a polishing unit for polishing a metal film installed in the clean room;

a first vessel capable of storing a polishing material which is comprised of abrasive free slurry for metal polishing, having a condensed concentration of said slurry, the first vessel being installed in the vicinity of the polishing unit;

a second vessel for storing an abrasive free slurry at the inside of the clean room, the abrasive free slurry being made using the polishing material; and a pipe for supplying the abrasive free slurry, in a diluted concentration of said slurry, to the polishing unit; and another pipe for transferring a diluent to said abrasive free slurry for metal polishing having a condensed concentration of said slurry, wherein said diluted concentration of said slurry is prepared.

19. A plant according to claim 18, further comprising a third vessel to which said abrasive free slurry for metal polishing, having a condensed concentration of said slurry, is transferred from said first vessel; and wherein said another pipe transfers said diluent to said third vessel, whereby said diluted concentration of said slurry is prepared in said third vessel.

20. A polishing apparatus comprising:

a polishing unit for polishing an object;

a first vessel;

a first supplying pipe for supplying a first polishing material to the first vessel;

a second supplying pipe for supplying a second polishing material to be mixed with the first polishing material;

a fourth supplying pipe for supplying one of a third polishing material and a solvent of the first polishing material to the first vessel;

a mixture unit in which is mixed the first polishing material and the second polishing material to make a liquid including abrasive powder concentration less than one weight percent of the combined weight of liquid and abrasive powder, the mixture unit being installed in the vicinity of the polishing unit; and a third supplying pipe to supply the liquid to the polishing unit.

21. A plant comprising:

a clean room;

a polishing unit for polishing an object installed in said clean room;

a first vessel for storing a polishing material, the first vessel being installed outside of the clean room and in the vicinity of the polishing unit;

a second vessel for storing an abrasive free slurry at the inside of the clean room, the abrasive free slurry being made using the polishing material; and a pipe for supplying the abrasive free slurry to the polishing unit.

* * * * *